United States Patent [19]

Baldwin

[11] Patent Number: 4,520,435

[45] Date of Patent: May 28, 1985

[54] ORIENTABLE REFRACTOR MOUNTING

[75] Inventor: Samuel L. Baldwin, East Flatrock, N.C.

[73] Assignee: General Electric Company, Schenectady, N.Y.

[21] Appl. No.: 548,602

[22] Filed: Nov. 4, 1983

[51] Int. Cl.[3] ..... F21V 3/00

[52] U.S. Cl. ..... 362/311; 362/335; 362/355; 362/361; 362/363; 362/374; 362/375; 362/453; 362/454; 362/455

[58] Field of Search ..... 362/311, 335, 355, 361, 362/363, 374, 375, 453, 454, 455

[56] References Cited

U.S. PATENT DOCUMENTS 3,461,283 8/1969 Hahn ..... 362/374

4,388,681 6/1983 Meyer ..... 362/374

*Primary Examiner*—Stephen J. Lechert, Jr.

*Attorney, Agent, or Firm*—Ernest W. Legree; Philip L. Schlamp; Fred Jacob

[57] ABSTRACT

A polycarbonate orientable refractor for a luminaire comprises a mounting ring which has a collar portion fitting a neck portion of the refractor with matching diameters. A diametric interference is provided between a groove in one part and a mating ridge in the other part to an extent allowing a snap fit. Shallow interfering ribs and valleys in the mating surfaces controllably lock the parts together while allowing angular indexing for orienting the light distribution pattern of the refractor.

7 Claims, 2 Drawing Figures

ORIENTABLE REFRACTOR MOUNTING

This invention relates to an orientable optical control appliance for a luminaire such as a refractor and more particularly to the mounting means therefor.

BACKGROUND OF THE INVENTION

Optical control appliances for luminaires such as refractors and reflectors which provide a non-symmetrical light distribution pattern may require a mounting scheme allowing orientation or angular adjustment about the mounting axis. For instance in a luminaire where the refractor provides two oppositely directed beams of light for lighting up and down a corridor, or a single broad beam for lighting away from a mounting wall, orientation is needed. Where the fixture does not have a fixed orientation relative to the task, angular adjustability of the optics is all the more necessary.

The feature of orientability is particularly desirable in retrofit type high intensity discharge (HID) lamp adapter fixtures. Typically such units replace an incandescent lamp of several hundred watts by an HID lamp of much smaller wattage, for instance a 300 watt incandescent lamp by a 35 or 50 watt high pressure sodium vapor lamp. The unit including ballast and lamp is mounted by screwing a screw base on the housing or fixture head into the socket that accommodated the incandescent lamp which it replaces. Such a mounting arrangement cannot effectively provide angular adjustment or orientation about the vertical axis. The thread pitch of 7 threads per inch in the conventional medium screw base is so coarse that the insertion tolerance is much less than 1 turn. In other words, one cannot resort to screwing in the housing tighter into the socket in order to achieve a particular orientation, and doing so may damage the base threads or the socket threads or both. It will be appreciated that the optics require individual adjustment to position the light beam with respect to the task. Providing a predetermined orientation relative to the socket is not enough because the sockets may be randomly oriented relative to the task.

SUMMARY OF THE INVENTION

The object of the invention is to provide a simple inexpensive mounting means for luminaire optical control appliances such as a refractor or a combination refractor-reflector which permits angular adjustment of the appliance relative to the luminaire.

In a mounting means embodying the invention, a rotatable mounting ring making an interference fit with a cylindrical neck portion of the appliance is provided, and angular adjustment of the appliance relative to the ring provides orientability.

In a preferred embodiment, appliance and mounting ring are made of light-transmitting material having a measure of flexibility and elasticity, such as polycarbonate or acrylic resins. A diametric interference is provided between a groove in one part and a mating ridge in the other part. Assembly is accomplished by forcing the parts together to snap them into place with the ridge seized in the groove. Shallow interfering ribs and valleys in the mating surfaces of the appliance and ring controllably lock the parts together while allowing angular indexing to provide orientability.

DETAILED DESCRIPTION

Figure 1:
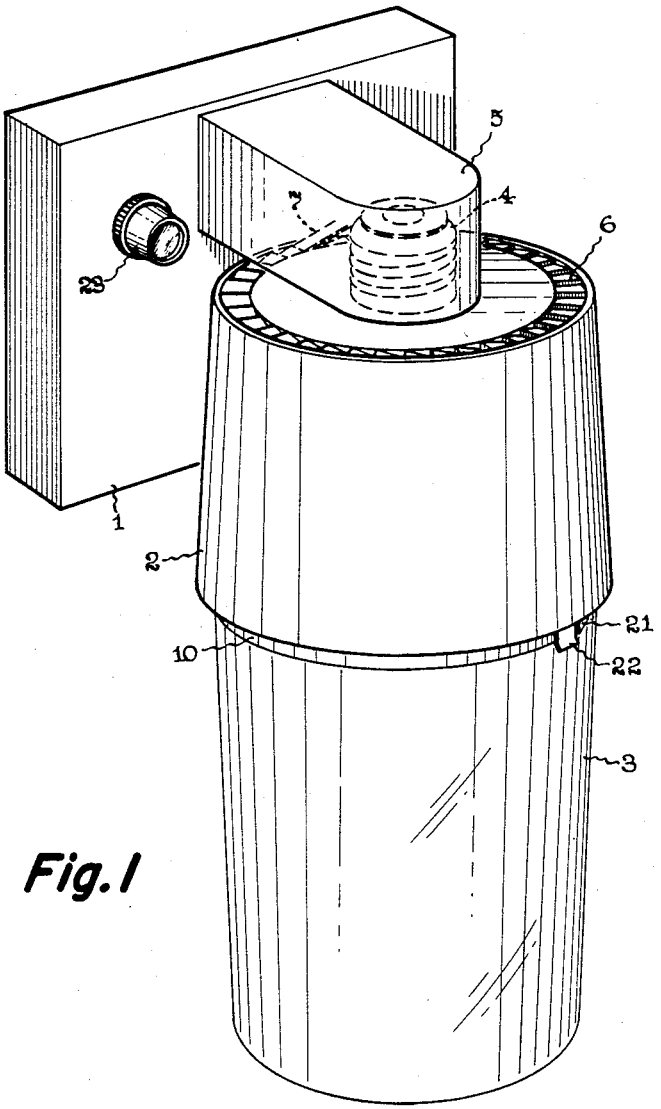
FIG. 1 is a pictorial view of a luminaire comprising wall mounting bracket, adapter type screw-in housing, and refractor embodying the invention.

Referring to the drawings, there is shown a wall-mounted luminaire assembly in which the invention is embodied. The assembly comprises a wall mounting bracket 1, an adapter type housing 2, and a light-transmitting refractor 3. The bracket and the housing are suitably made of a molded engineering plastic such as nylon or fiberglass-reinforced polyester. A medium screw base 4 is incorporated into the housing top and screws into a conventional socket (not shown) in the projecting arm 5 of the bracket. Ratchet teeth 6 molded in the housing top are engaged by a spring blade 7 serving as an anti-pilfering device to secure the unit. The screw base also allows the housing to be mounted and suspended directly from an existing socket if preferred, which socket may be ceiling or wall hung. The housing contains a ballast capable of starting and operating an appropriate HID lamp which depends from the housing and is enclosed within the refractor. By way of preferred example, the lamp may be a 35 watt or a 50 watt high pressure sodium vapor lamp (not shown) and it is screwed into socket 8 in the housing bottom.

The illustrated refractor 3 is generally cylindrically shaped with a closed bottom and is preferably made of thin-walled clear polycarbonate plastic. The cylindrical wall has a pattern of optical surfaces such as prisms 9 molded into it. In addition to or in lieu of refracting prisms, reflecting coatings may be applied to the wall. The light control surfaces are preferably provided on the inside of the refractor in order to have a smooth outside surface less apt to collect soil and easily cleaned.

Figure 2:
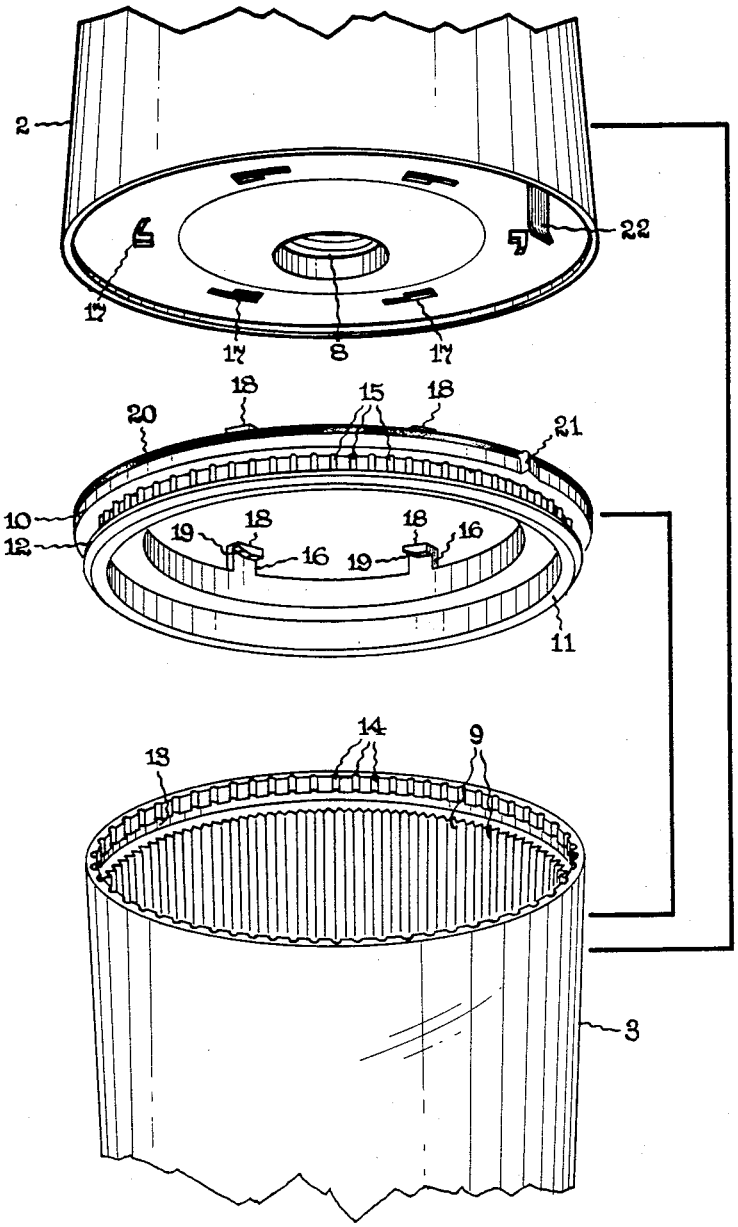
FIG. 2 is a vertically exploded, pictorial view of the fixture showing the relationship between housing, mounting ring and refractor.

When the optical surfaces cause a non-symmetrical distribution of the transmitted light, it is necessary to orient the refractor relative to the task. The neck or upper end of the refractor is fitted with a mounting ring 10 which is shown raised above it in exploded fashion in FIG. 2. The ring is conveniently made of clear polycarbonate plastic like the refractor. The ring has a depending collar portion 11 whose outer diameter fits the inner diameter of the neck or upper end of the refractor. An external ridge 12 near the bottom of the collar mates with an internal groove 13 in the neck of the refractor. There is diametric interference between the ridge and the inner surface of the refractor neck next to the groove, for instance 0.040" for the case of 3½" diameter refractor as illustrated. The non-rigid thin-walled plastic material of the neck will stretch when the collar with its ridge is forced into it, resulting in a snap fit. Retention of the parts in assembly and adequate sealing are achieved when ridge 12 is seated in groove 13. The mated ridge and groove allow angular rotation of the refractor and there is enough friction to maintain the setting in ordinary circumstances.

In a preferred construction, shallow radial depressions or valleys 14 on the inside of the refractor are engaged by matching protuberances or ribs 15 on the outside of the ring collar. The interengagement of ribs and valleys controllably resist rotation of the refractor with respect to the ring. Break-away torque to allow rotation is determined by the extent of interference and the proximity of the detenting ribs and valleys. It is set high enough to allow the refractor to be installed or removed from the housing, yet low enough to permit ready adjustment by the user without damage to any component by the application of excessive force.

The mounting ring is provided with six vertically rising tabs 16 which are disposed to penetrate slotted apertures 17 in the bottom wall of housing 2. Each tab has foot portion 18 directed radially inwards which engages a cooperating locking portion about the accommodating aperture when the refractor is twisted clockwise relative to the housing. The leading side 19 of the foot is inclined or ramped slightly in order to cause compression of a sealing gasket 20 when the refractor is mounted on the housing. A latch detent 21 on the ring in conjunction with a springy latch tab 22 depending from the lower face of the housing secures the refractor to the housing. This permits adjustment of the refractor relative to the mounting ring in both directions for orientation. The latch is easily disengaged to permit removal of the refractor without loss of orientation. A photoelectric controller for the lamp may conveniently be mounted on the wall bracket above the level of the housing as indicated at 23.

The preferred construction of mounting ring which has been illustrated uses tabs with feet portions for atattachment to the housing. Other attaching means such as conventional threads on the mounting ring may be used if preferred. However the particular mounting ring which has been described is so convenient and economical that it is used by applicant's assignee even with symmetrical refractors which do not require orientability.

While I have described my invention with reference to a specific embodiment, numerous modifications may be made without departing from the true scope of the invention and I intend by the appended claims to cover all such equivalent variations.

What I claim as new and desire to secure by Letters Patent of the United States is:

1. An optical control appliance in the nature of a refractor or reflector adapted to surround at least in part the light source in a luminaire and mounting means therefor comprising:

a cylindrical neck portion on said appliance, a mounting ring having a collar portion fitting said neck portion with matching diameters, a mating ridge and groove, one on the collar portion and the other on the neck portion, said ridge causing diametric interference with the portion next to the groove to an extent allowing a snap fit, and attachment means on said ring for engaging a luminaire housing.

2. An optical control appliance and mounting means therefor as in claim 1 wherein said mounting ring has a dependent collar which fits inside the neck portion of the appliance.

3. An optical control appliance and mounting means therefor as in claim 2 wherein the ridge is on the outside of the collar while the mating groove is on the inside of the neck portion.

4. An optical control appliance and mounting means therefor as in claim 1 or 3 wherein there are shallow interengaging radial protuberances and depressions as between collar portion and neck portion providing controlled resistance to rotation of the appliance relative to the ring.

5. An optical control appliance and mounting means therefor as in claim 1 wherein said attachment means comprise a plurality of vertical tabs having feet portions disposed to penetrate and engage slotted apertures in the bottom of the housing.

6. An optical control appliance and mounting means therefor as in claim 3 wherein said appliance is a thin-walled refractor of a light-transmitting plastic.

7. An optical control appliance and mounting means therefor as in claim 6 wherein said plastic is a polycarboante.

* * * * *